United States Patent [19]

Cassano et al.

[11] Patent Number: 4,905,052

[45] Date of Patent: Feb. 27, 1990

[54] SHEET TRANSPORT VELOCITY MISMATCH COMPENSATION APPARATUS

[75] Inventors: James R. Cassano, Penfield; Richard M. Dastin, Fairport; Scott C. Durland; Arthur J. Sobon, both of Rochester, all of N.Y.

[73] Assignee: Xerox Corporation, Stamford, Conn.

[21] Appl. No.: 318,990

[22] Filed: Mar. 6, 1989

[51] Int. Cl.[4] ..... G03G 15/00

[52] U.S. Cl. ..... 355/312; 355/309; 271/306; 271/3.1

[58] Field of Search ..... 355/312, 309, 316, 318, 355/321; 291/3.1, 306

[56] References Cited

U.S. PATENT DOCUMENTS

| | | | |
|---|---|---|---|
| 3,902,645 | 9/1975 | Keck | 226/44 |
| 4,017,065 | 4/1977 | Poehlein | 271/80 |
| 4,058,306 | 11/1977 | Fletcher | 271/80 |
| 4,272,181 | 6/1981 | Treseder | 355/312 X |
| 4,286,863 | 9/1981 | Cornwall et al. | 355/312 X |
| 4,362,380 | 12/1982 | Dragstedt | 355/312 |
| 4,365,889 | 12/1982 | Silverberg | 355/312 X |
| 4,375,326 | 3/1983 | Lang | 355/312 X |
| 4,561,581 | 12/1985 | Kelly | 226/113 |

*Primary Examiner*—A. C. Prescott

*Attorney, Agent, or Firm*—H. Fleischer; J. E. Beck; R. Zibelli

[57] ABSTRACT

An apparatus which compensates for the velocity mismatch between adjacent sheet transports. A plate, interposed between the sheet transports, supports the sheet until the leading edge thereof advances from the first sheet transport to the second sheet transport. When the leading edge of the sheet is received by the second sheet transport, the plate pivots away from the sheet to a location remote therefrom. Since the first sheet transport advances the sheet at a greater velocity than the second sheet transport, the sheet forms a buckle to compensate for the velocity mismatch between sheet transports.

16 Claims, 2 Drawing Sheets

SHEET TRANSPORT VELOCITY MISMATCH COMPENSATION APPARATUS

Figure 1:
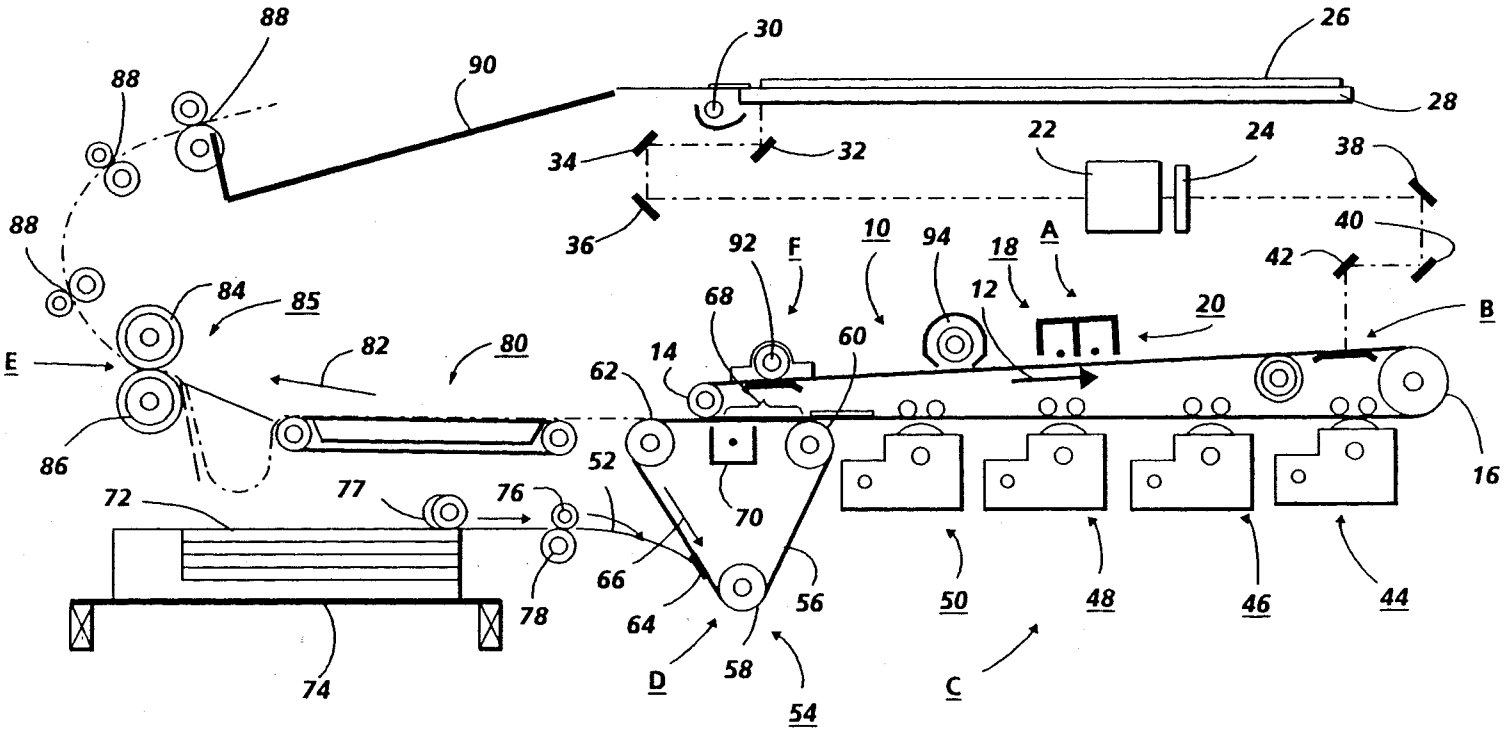

This invention relates generally to an electrophotographic printing machine, and more particularly concerns an apparatus that compensates for velocity mismatches in transporting a sheet along a path.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The marking particles are heated to permanently affix them to the copy sheet, in image configuration.

Multi-color electrophotographic printing is substantially identical to the foregoing process of black and white printing. However, rather than forming a single latent image on the photoconductive surface, successive single color latent images corresponding to color separated light images of the original document are recorded thereon. Each single color electrostatic latent image is developed with toner particles of a color complimentary thereto. This process is repeated a plurality of cycles for differently colored images and their respective complimentarily colored toner particles. Each single color toner powder image is transferred to the copy sheet in superimposed registration with the prior toner powder image. This creates a multi-layered toner powder image on the copy sheet. Thereafter, the multi-layered toner powder image is permanently affixed to the copy sheet creating a color copy.

In order to fix the multi-layered toner powder image to the copy sheet, heat is applied thereto by a fuser. The multi-layers of toner, which make up the toner powder image on the copy sheet, require more energy to fuse than single layers of toner. This is achieved by a longer dwell time and/or higher temperatures. In order to increase the dwell time in the fuser, the velocity of the copy sheet is decreased as it passes through the fuser. This results in a velocity mismatch between the velocity of the copy sheet prior to the fuser and the velocity mismatch must be provided. Various approaches have been devised which compensate for velocity mismatches in the sheet transports of a printing machine. The following disclosures appear to be relevant:

US-A-3,902,645; Patentee: Keck; Issued: Sept. 2, 1975,

US-A-4,017,065; Patentee: Poehlein; Issued: Apr. 12, 1977,

US-A-4,058,306; Patentee: Fletcher; Issued: Nov. 15, 1977,

US-A-4,561,581; Patentee: Kelly; Issued: Dec. 31, 1985,

The relevant portions of the foregoing disclosures may be briefly summarized as follows:

US-A-3,902,645 describes a machine which includes rolls between which a flexible sheet is passed. After passing from one section, the flexible sheet falls downwardly to form a loop, the other side of which passes upwardly into another section of the machine. A motor drives a roll which advances the sheet from one section one to the other section. A pivotable plate contacts the lowermost region of the loop. The direction that the plate pivots depends upon the whether the loop is increasing or decreasing. The direction that the plate pivots controls the speed of the motor advancing the sheet.

US-A-4,017,065 and US-A-4,058,306 disclose a vacuum support interposed between the fuser and the photoreceptor. When the lead edge of the copy sheet enters the fuser roll nip, the vacuum is turned off and a buckle forms in the sheet due to the speed mismatch between the fuser and the photoreceptor.

US-A-4,561,581 describes a web accumulator positioned between a variable speed drive and an intermittent drive. A portion of a web in the accumulator is curved into a downward extending loop by a curved support and the force of gravity acting on the web.

Pursuant to the features of the present invention, there is provided an apparatus that compensates for velocity mismatches in transporting a sheet along a path. The apparatus includes a first sheet transport adapted to advance the sheet along a first portion of the path at a first velocity. A second sheet transport is adapted to advance the sheet along a second portion of the path at a second velocity with the first velocity of the first sheet transport being greater than the second velocity of the second sheet transport. Means, interposed between the first sheet transport and the second sheet transport, support the sheet as the sheet moves from the first sheet transport to the second sheet transport. The supporting means is adapted to move away from the sheet when the leading edge of the sheet is received by the second sheet transport so as to form a buckle in the sheet due to the second sheet transport advancing the sheet at a slower velocity than the first sheet transport.

In another aspect of the present invention, there is provided an electrophotographic printing machine in which a copy sheet advances along a path so that a toner image is transferred thereto from a photoconductive member. The improvement includes a first sheet transport adapted to advance the copy sheet along a first portion of the path at a first velocity. A second sheet transport is adapted to advance the copy sheet along a second portion of the path at a second velocity with the first velocity of the first sheet transport being greater than the second velocity of the second sheet transport. Means, interposed between the first sheet transport and the second sheet transport, support the copy sheet as the copy sheet moves from the first sheet transport to the second sheet transport. The supporting means is adapted to move away from the copy sheet when the leading edge of the copy sheet is received by the second sheet transport so as to form a buckle in the copy sheet due to the second sheet transport advancing the sheet at a slower velocity that the first sheet transport.

Figure 2:
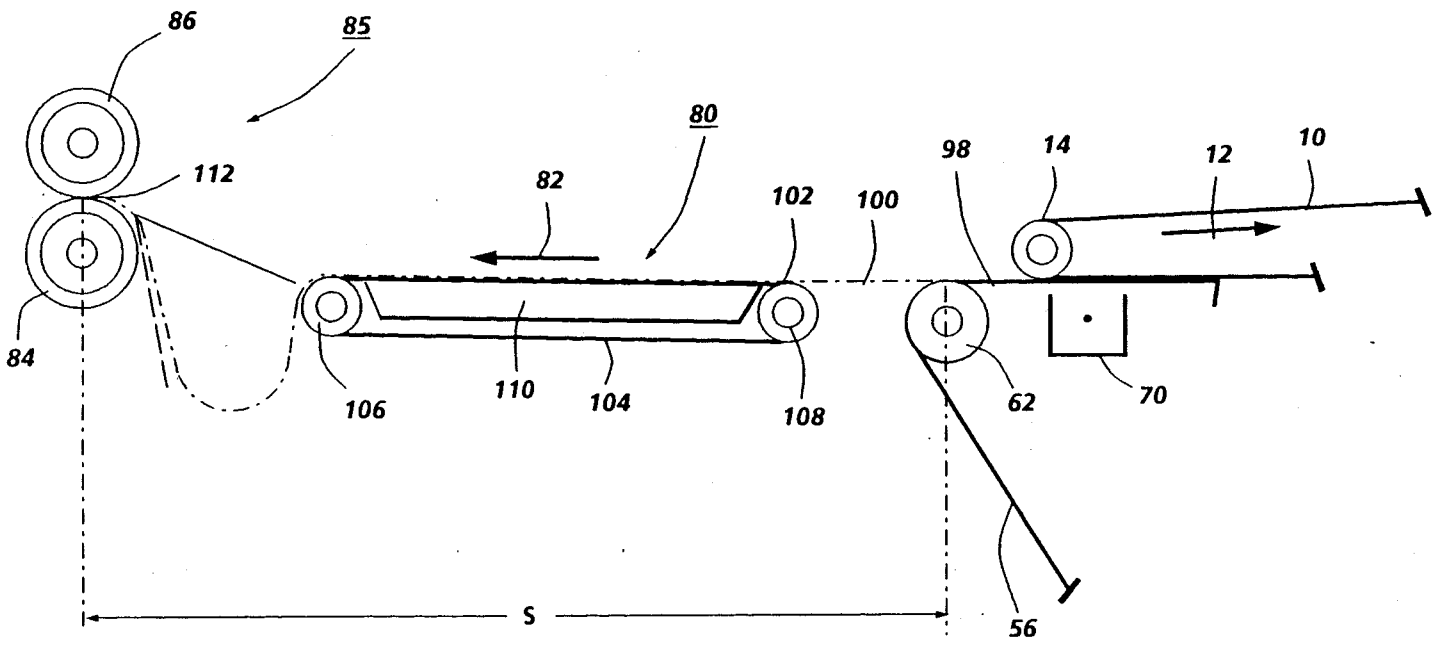

Other aspects of the present invention will become apparent as the following description proceeds and upon reference to the drawings, in which:

FIG. 1 is a schematic elevational view depicting an electrophotographic printing machine incorporating the sheet transport velocity mismatch compensation apparatus of the present invention therein; and FIG. 2 is an elevational view showing further details of the sheet transport velocity mismatch compensation apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the sheet transport velocity mismatch compensation apparatus of the present invention therein. It will become evident from the following discussion that the apparatus of the present invention is equally well suited for use in a wide variety of printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, two corona generating devices, indicated generally by the reference numerals 18 and 20 charge photoconductive belt 10 to a relatively high, substantially uniform potential. Corona generating device 18 places all of the required charge on photoconductive belt 10. Corona generating device 20 acts as a leveling device, and fills in any areas missed by corona generating device 18.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are reflected by mirrors 38, 40, and 42 to be focused on the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document.

Subsequent to the recording of the electrostatic latent image on photoconductive belt 10, belt 10 advances the electrostatic latent image to development station C. Development station C includes four individual developer units generally indicated by the reference numerals 44, 46, 48 and 50. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 44, 46, and 48, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 46 with blue absorbing (yellow) toner particles, while the red separation is developed by developer unit 48 with red absorbing (cyan) toner particles. Developer unit 50 contains black toner particles and may be used to develop the electrostatic latent image formed from a black and white original document. Each of the developer units is moved into and out of the operative position. In the operative position, the magnetic brush is closely adjacent the photoconductive belt, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 1, developer unit 44 is shown in the operative position with developer units 46, 48 and 50 being in the nonoperative position.

After development, the toner image is moved to transfer station D where the toner image is transferred to a sheet of support material 52, such as plain paper amongst others. At transfer station D, the transfer conveyor, indicated generally by the reference numeral 54, moves sheet 52 into contact with photoconductive belt 10. Photoconductive belt 10 moves at a velocity of about 7.5 inches per second in the direction of arrow 12. Transfer conveyor 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to transfer conveyor 54. Sheet 52 is advanced by forwarding rollers 76 and 78 in synchronism with the movement of gripper 64. In this way, the leading edge of sheet 52 arrives at a preselected position to be received by the open gripper 64. The gripper then closes securing the sheet thereto for movement therewith in a recirculating path. The leading edge of the sheet is secured releasably by gripper 64. As the belts move in the direction of arrow 66, sheet 52 moves into contact with the photoconductive belt, in synchronism with the toner image developed thereon, at the transfer zone 68. Transfer conveyor 54 advances sheet 52 at about 7.5 inches per second. A corona generating device 70 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging the photoconductive surface, exposing the photoconductive surface to a specific color of the flowing light image of the original document, developing the electrostatic latent image recorded on the photoconductive surface with appropriately colored toner, and transferring the toner images to the sheet of support material are repeated a plurality of cycles to form a multi-color copy of a colored original document.

During transfer of the toner powder images to sheet 52, sheet 52 is electrostatically tacked to photoconductive belt 10 and moves therewith. After the last transfer operation, the lead edge of sheet 52 is stripped from photoconductive belt as it approaches roller 14. Thereafter, grippers 64 open and release sheet 52. A sheet transport, indicated generally by the reference numeral 80, then acquires the lead edge of sheet 52. Sheet transport 80 is a vacuum transport so that the sheet is secured releasably to the belts of the the transport by the vacuum applied thereon. Sheet transport 80 transports sheet 52, in the direction of arrow 82, onto a support plate 83. Support plate 83 contacts the surface of sheet 52 opposed from the surface having the toner powder images transferred thereto. Thus, the unfused toner powder images on sheet 52 are not contacted by plate 83 and remian undisturbed. Plate 83 guides the lead edge of sheet into the nip defined by fuser roller 84 and pressure roll 86 of fuser 85 in fusing station E to permanently fix the transferred image to sheet 52. Sheet 52 passes through the nip defined by fuser roll 84 and pressure roll 86. The toner powder image contacts fuser roll 84 so as to be affixed to sheet 52. Sheet transport 80 advances sheet 52 at a velocity of about 7.5 inches per second. Fuser roller 84, cooperating with pressure roller 86, advances sheet 52 at a velocity of about 2 inches per second. This provides a sufficiently long dwell time to permanently fix the multi-layered toner powder image to sheet 52. However, the velocity mismatch between sheet transport 80 and the sheet transport, defined by fuser 85, requires compensation. This is achieved by pivoting plate 83 downwardly away from sheet 52 after the lead edge of sheet 52 has entered the nip defined by fuser roller 84 and pressure roller 86. In this way, plate 52 is positioned remotely from sheet 52. Plate 83 is shown in the remote position by dashed lines and, in the sheet support position by a solid line in FIGS. 1 and 2. The length of sheet 52 is greater than the distance between the nip and the point of stripping the sheet from photoconductive belt 10. Of course, the length of the sheet is therefore also greater than the distance between the nip and the end of sheet transport 80. After plate 83 pivots downwardly away from the sheet, the velocity mismatch, the angle between sheet transport 80 and plate 83, and the force of gravity form a buckle in the sheet. Once the trail edge of the sheet leaves photoconductive belt 10, the sheet transport is de-energized so that sheet transport 80 is no longer advancing the sheet. However, the vacuum remains on. In this way, the sheet buckle is contained and positive control of the trailing edge of the sheet maintained. As the sheet continues to advance through the nip, the buckle in the sheet is slowly eliminated and the trailing portion of the sheet is dragged off the sheet transport. After sheet 52 exits the nip defined by fuser roller 84 and pressure roller 86, sheet 52 is advanced by forwarding roll pairs 88 to catch tray 90 for subsequent removal therefrom by the machine operator. While the buckle and trail edge of the copy sheet are being contained by the sheet transport, the rest of the printing machine continues to process the next copy. Inasmuch as a full color copy takes three passes, there is sufficient time to remove the copy at 2 inches/second before the next copy makes the transition to sheet transport 80. Further details of the foregoing are shown in FIG. 2.

With continued reference to FIG. 1, the last processing station in the direction of movement of belt 10, as indicated by arrow 12 is cleaning station F. A rotatably mounted fibrous brush 92 is positioned in cleaning station F and maintained in contact with photoconductive belt 10 to remove residual toner particles remaining after the transfer operation. Thereafter, lamp 94 illuminates photoconductive belt 10 to remove any residual charge remaining thereon prior to the start of the next successive cycle.

Referring now to FIG. 2, there is shown the sheet advancing from photoconductive belt 10 after the last toner powder image has been transferred thereto. During transfer, the sheet is electrostatically tacked to photoconductive belt 10 and moves in unison therewith at a velocity of about 7.5 inches per second. Sheet 52 is electrostatically tacked to photoconductive belt 10 at region 96. After transfer of the last toner powder image is completed, the lead edge of the sheet is stripped from photoconductive belt 10 at region 98. At region 100 of the path, gripper 64 (FIG. 1) releases the lead edge of sheet 52. At region 102, the lead edge of sheet 52 is acquired by sheet transport 80. Sheet transport 80 includes a plurality of belts 104 entrained about rollers 106 and 108. Roller 106 is spaced from roller 108. A vacuum plenum 110 is positioned interiorly of belts 104 so as to reduce the pressure at the surface thereof to vacuum tack sheet 52 thereon. Roller 106 is driven by a motor to move belts 104 in the direction of arrow 82 at a velocity of about 7.5 inches per second. In this way, sheet 52, secured by the vacuum releasably on belts 104, moves in unison therewith in the direction of arrow 82. As the lead edge of sheet 52 advances, it is guided by plate 83 into the nip 112 defined by fuser roller 84 and pressure roller 86. Fuser roller 84 and pressure roller 86 cooperate with one another to advance sheet 52 through nip 112 at about 2 inches per second. When the lead edge of sheet 52 enters nip 112, plate 83 pivots downwardly in a clockwise direction to a position remote from sheet 52, as shown by the dotted line. Plate 83 extends across the width of sheet transport 80 in a direction perpendicular to the direction of movement of sheet 52 as indicated by arrow 82. One end of plate 83 is mounted pivotably on the printing machine frame. The other end of plate 83 is held in the operative position supporting the sheet by a solenoid. When the solenoid is de-energized, plate 83 pivots downardly under the force of gravity to a position remote from sheet 52. Inasmuch as the sheet transport defined by fuser roller 84 and pressure roller 86 advances the sheet at a slower velocity than sheet transport 80, a buckle forms in the sheet to compensate for the velocity mismatch. A downward buckle is created by the natural curve of the sheet, the angle between the direction of travel of the sheet on sheet transport 80 and the direction of travel of the sheet along plate 83 into nip 112 of fuser 85, and the force of gravity. Once the trail edge of the sheet leaves the photoconductive belt, drive roller 106 of sheet transport 80 is de-energized and belts 104 no longer advance sheet 52 in the direction of arrow 82. In this way, the buckle is contained. However, vacuum plenum 110 remains energized and the portion of sheet 52 thereon remains tacked thereto. As fuser roller 84 and pressure roller 86 continue to rotate, sheet 52 continues to advance through nip 112. Since the vacuum is maintained, the poriton of sheet 52 thereon is dragged off sheet transport 80. The distance S between the end of sheet transport 54 and nip 112 is less than the length of the copy sheet. Accordingly, the distance between the end of sheet transport 80 and nip 112 is less than the length of the copy sheet. In this way, the fuser has firm control of the lead edge of sheet 52 without any slippage of the sheet relative to photoconductive belt 10. Since the sheet does not slip on the photoconductive belt, there is no significant copy quality degradation.

In recapitulation, the fuser of an electrophotographic printing machine advances the copy sheet therethrough at a slower velocity than the machine processing velocity. A plate is interposed between the end of the sheet transport and the fuser. When the lead edge of the sheet is received in the nip defined by the fuser roller and the pressure roller, the plate moves to a position spaced from the sheet and a buckle forms therein to compensate for the velocity mismatch.

It is, therefore, evident that there has been provided in accordance with the present invention, an apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. An apparatus that compensates for velocity mismatches in transporting a sheet along a path, including:

a first sheet transport adapted to advance the sheet along a first portion of the path at a first velocity.

a second sheet transport adapted to advance the sheet along a second portion of the path at a second velocity with the first velocity of said first sheet transport being greater than the second velocity of said second sheet transport; and means, interposed between said first sheet transport and said second sheet transport, for supporting the sheet as the sheet moves from said first sheet transport to said second sheet transport, said supporting means being adapted to move away from the sheet when the leading edge of the sheet is received by said second sheet transport so as to form a buckle in the sheet due to said second sheet transport advancing the sheet at a slower velocity than said first sheet transport.

2. An apparatus according to claim 1, wherein a decreasing portion of the sheet is secured releasably to said first sheet transport as the sheet is being advanced by said first sheet transport and said second sheet transport.

3. An apparatus according to claim 2, wherein said second sheet transport is spaced a distance less than the length of the sheet from said first sheet transport.

4. An apparatus according to claim 3, wherein said first sheet transport includes:

a conveyor belt; and vacuum means in communication with said conveyor belt to releasably secure the sheet thereto.

5. An apparatus according to claim 4, wherein said second sheet transport includes a pair of rollers defining a nip through which the sheet advances.

6. An apparatus according to claim 5, wherein said supporting means includes a plate arranged to pivot from a position supporting the sheet to a position remote therefrom after the leading edge of the sheet enters the nip of said pair of rollers so that a buckle is formed in the sheet.

7. An apparatus according to claim 6, wherein said plate pivots in a downwardly direction.

8. An apparatus according to claim 7, wherein said first sheet transport is de-energized when the sheet lead edge enters the nip defined by said pair of rollers.

9. An electrophotographic printing machine in which a copy sheet advances along a path so that a toner image is transferred thereto from a photoconductive member, wherein the improvement includes:

a first sheet transport adapted to advance the copy sheet along a first portion of the path at a first velocity;

a second sheet transport adapted to advance the copy sheet along a second portion of the path at a second velocity with the first velocity of said first sheet transport being greater than the second velocity of said second sheet transport; and means, interposed between said first sheet transport and said second sheet transport, for supporting the copy sheet as the copy sheet moves from said first sheet transport to said second sheet transport, said supporting means being adapted to move away form the copy sheet when the leading edge of the copy sheet is received by said second sheet transport so as to form a buckle in the copy sheet due to said second sheet transport advancing the sheet at a slower velocity than said first sheet transport.

10. A printing machine according to claim 9, wherein the copy sheet is releasably secured to said first sheet transport as the sheet is being advanced by said first sheet transport and said second sheet transport.

11. A printing machine according to claim 10, wherein said second sheet transport is spaced a distance less than the length of the sheet from said first sheet transport.

12. A printing machine according to claim 11, wherein said first sheet transport includes:

a conveyor belt; and vacuum means in communication with said conveyor belt to releasably secure the sheet thereto.

13. A printing machine according to claim 12, wherein said second sheet transport includes a pair of rollers defining a nip through which the sheet advances, at least one of said pair of rollers being heated to fuse the toner image to the copy sheet as the copy sheet advances through the nip.

14. A printing machine according to claim 1, wherein said supporting means includes a plate arranged to pivot from a position supporting the sheet to a position remote therefrom after the leading edge of the sheet enters the nip of said pair of rollers so that a buckle is formed in the sheet.

15. A printing machine according to claim 14, wherein said plate pivots in a downwardly direction.

16. A printing machine according to claim 15, wherein said first sheet transport is de-energized when the sheet lead edge enters the nip defined by said pair of rollers.

* * * * *